US009162863B2

(12) United States Patent
Till

(10) Patent No.: US 9,162,863 B2
(45) Date of Patent: Oct. 20, 2015

(54) METHOD OF STORING BEER KEGS AND DISPENSING BEER IN A COMMERCIAL BAR OR RESTAURANT, A METHOD OF STORING BEVERAGE BARRELS IN A COMMERCIAL BAR OR RESTAURANT, AND AN APPARATUS THEREFOR

(75) Inventor: Volker Till, Hofheim am Taunus (DE)

(73) Assignee: KHS GmbH, Dortmund (DE)

( * ) Notice: Subject to any disclaimer, the term of this patent is extended or adjusted under 35 U.S.C. 154(b) by 902 days.

(21) Appl. No.: 12/419,016

(22) Filed: Apr. 6, 2009

(65) Prior Publication Data

US 2010/0089943 A1 Apr. 15, 2010

Related U.S. Application Data

(63) Continuation-in-part of application No. PCT/EP2007/007816, filed on Sep. 7, 2007.

(30) Foreign Application Priority Data

Oct. 7, 2006 (DE) ..... 10 2006 047 524

(51) Int. Cl.

| | |
|---|---|
| ***B67D 1/08*** | (2006.01) |
| ***B67D 3/00*** | (2006.01) |
| ***B67D 7/34*** | (2010.01) |

(52) U.S. Cl.

CPC ..... *B67D 1/0884* (2013.01); *B67D 1/0888* (2013.01); *B67D 3/0006* (2013.01); *B67D 7/348* (2013.01)

(58) Field of Classification Search

CPC .. B67D 1/0884; B67D 1/0888; B67D 1/0882; B67D 3/0006; B67D 7/348

USPC ..... 222/23, 54, 55, 59, 61, 71, 146.1, 222/146.6; 6/23, 54, 55, 59, 61, 71, 146.1, 6/146.6

See application file for complete search history.

(56) References Cited

U.S. PATENT DOCUMENTS 4,869,396 A * 9/1989 Horino et al. ..... 222/54
5,303,845 A * 4/1994 Osawa ..... 222/1

(Continued)

FOREIGN PATENT DOCUMENTS

DE 28 27 900 1/1980
DE 44 46 203 6/1996

(Continued)

OTHER PUBLICATIONS

International Preliminary Report on Patentability PCT/EP2007/007816 and English translation thereof.

(Continued)

*Primary Examiner* — Jason Boeckmann
(74) *Attorney, Agent, or Firm* — Nils H. Ljungman & Associates

(57) ABSTRACT

A method of storing beer kegs and dispensing beer in a commercial bar or restaurant, a method of storing beverage barrels in a commercial bar or restaurant, and an apparatus therefor. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

16 Claims, 2 Drawing Sheets

(56) References Cited

U.S. PATENT DOCUMENTS

| | | | | |
|---|---|---|---|---|
| 6,237,652 | B1 * | 5/2001 | Nelson | 141/263 |
| 2002/0063762 | A1 | 5/2002 | Jozef Haan et al. | |
| 2004/0084475 | A1 | 5/2004 | Bethuy et al. | |
| 2005/0103799 | A1 | 5/2005 | Litterst et al. | |
| 2006/0169715 | A1 * | 8/2006 | Emmendorfer et al. | 222/59 |
| 2007/0203587 | A1 * | 8/2007 | Erlandsson et al. | 700/11 |

FOREIGN PATENT DOCUMENTS

| | | | |
|---|---|---|---|
| DE | 298 22 967 | | 5/2000 |
| DE | 199 48 471 | | 4/2001 |
| DE | 100 60 629 | | 6/2002 |
| DE | 601 15 184 | | 7/2006 |
| DE | 102004063123 | | 7/2006 |
| JP | 8133397 | A | 5/1996 |
| JP | 11073461 | A | 3/1999 |
| JP | H 1173219 | A | 3/1999 |
| JP | 11268744 | A | 10/1999 |
| JP | 2005170389 | | 6/2005 |
| JP | 2005-339210 | A | 12/2005 |
| WO | WO 03/005295 | | 1/2003 |
| WO | WO 2004/056695 | | 7/2004 |
| WO | WO 2005/070816 | | 8/2005 |

OTHER PUBLICATIONS

German Office Action DE 10 2006 047 524.0-23.

International Search Report PCT/EP2007/007816 and English translation thereof.

* cited by examiner

METHOD OF STORING BEER KEGS AND DISPENSING BEER IN A COMMERCIAL BAR OR RESTAURANT, A METHOD OF STORING BEVERAGE BARRELS IN A COMMERCIAL BAR OR RESTAURANT, AND AN APPARATUS THEREFOR

CONTINUING APPLICATION DATA

This application is a Continuation-In-Part application of International Patent Application No. PCT/EP2007/007816, filed on Sep. 7, 2007, which claims priority from Federal Republic of Germany Patent Application No. 10 2006 047 524.0, filed on Oct. 7, 2006. International Patent Application No. PCT/EP2007/007816 was pending as of the filing date of this application. The United States was an elected state in International Patent Application No. PCT/EP2007/007816.

BACKGROUND

1. Technical Field

The present application relates to a method of storing beer kegs and dispensing beer in a commercial bar or restaurant, a method of storing beverage barrels in a commercial bar or restaurant, and an apparatus therefor.

2. Background Information

Background information is for informational purposes only and does not necessarily admit that subsequently mentioned information and publications are prior art.

The present application relates to a method for the dispensing of products, in one possible embodiment beverages, housed and supplied in barrels such as kegs, for example, with the use of at least one tapping device with at least one tapping point and as a function of beverage-specific or product-specific parameters, and to an apparatus for the dispensing of products, in one possible embodiment beverages, housed in barrels, for example kegs, as a function of beverage-specific or product-specific parameters, with at least one tapping device with at least one tapping point.

Devices or dispensing systems for the dispensing of products and/or beverages are known both in the form of stationary systems as well as mobile systems in a wide variety of realizations, whereby the product to be dispensed is generally supplied in barrels or kegs. Some devices describe the equipping of kegs with transponders in which data are stored which are used exclusively to identify the type of product in the container and to improve the handling of the kegs. Some devices also describe the equipping of kegs with transponders in which data are stored, although the data are used exclusively to identify the type of product in the container and to improve the handling of the kegs.

Some methods and devices are for the dispensing of beverages housed and supplied in barrels or kegs. The object of these methods and devices is to dispense the beverage in question exclusively into drinking vessels which are suited or intended for this beverage, and the tapping device is closed to prevent, restrict, or minimize dispensing into an unsuitable vessel or any other than the drinking vessel. To make this possible, means are provided for the identification of the drinking vessel and for the identification of the product, and for example the latter also in the form of a transponder that is attached to the barrel in question.

Some devices are for the dispensing of mixed drinks which are mixed from a plurality of liquid ingredients immediately before the beverage is dispensed. For the identification of at least one ingredient in a container, for example a flavoring ingredient, a transponder is provided on the container in question in which data that identify this ingredient are stored, which are used during the dispensing of the mixed drink to control the mixing process.

Some devices describe an ink jet printing system with a plurality of ink containers, each of which is provided with a memory chip (e.g. EPROM), in which data that define an optimum operating temperature of the ink holder are stored. By means of exposed electrical contacts, the individual memory chip is connected with a reader head for the reading of the stored data.

OBJECT OR OBJECTS

An object of the present application is to describe a method with which the handling of the product and thereby in one possible embodiment the tapping or dispensing process and/or the storage process for the respective product can be optimally controlled and/or influenced.

SUMMARY

The present application teaches that this object can be accomplished by a method for the dispensing of products, in one possible embodiment beverages, housed and supplied in barrels such as kegs, for example, with the use of at least one tapping device with at least one tapping point and as a function of beverage-specific or product-specific parameters. The dispensing or tapping or dispensing process is performed under the control or influence of data which are stored in a product-specific manner in at least one transponder, whereby the at least one transponder is provided on the barrel that houses the product to be dispensed. The present application also teaches that this object can be accomplished by a method for the storage of products, in one possible embodiment beverages, housed in barrels, in one possible embodiment kegs, as a function of beverage-specific or product-specific parameters. The storage or the storage process is performed under the control or influence of data which are stored in a product-specific manner in at least one transponder, which is provided on the barrel that houses the product. An apparatus for the dispensing and/or storage of products, in one possible embodiment beverages, is an object of an apparatus for the dispensing of products, in one possible embodiment beverages, housed in barrels, for example kegs, as a function of beverage-specific or product-specific parameters, with at least one tapping device with at least one tapping point. The apparatus comprises a control device, which for the control of the dispensing or of the tapping process or dispensing process is realized in consideration of data that are stored in a product-specific manner in at least one transponder provided on the respective barrel. An apparatus for the dispensing and/or storage of products, in one possible embodiment beverages, is an object of an apparatus for the storage of products, in one possible embodiment beverages housed in barrels, for example kegs, as a function of beverage-specific or product-specific parameters. The apparatus comprises a control device which is realized for the control of the storage process, taking into consideration data that are stored in a product-specific manner in at least one transponder which is provided on the respective barrel.

The present application teaches that the tapping or dispensing process and/or the storage process of the individual product is controlled and/or influenced by the data stored in the respective transporter as a function of product-specific parameters. In the respective transponder, the product-specific parameters, which can be in the form of a multiple-character code word, for example, are stored directly and/or a product-specific identification is stored in the individual transporter. With this identification, a product-specific influencing and/or control of the tapping or dispensing process or of the storage process can then be exerted, for example by launching a program which is stored in a control unit or by retrieving and/or activating the product-specific parameters that are associated with the product in question which are stored in the control unit, which are then used for the control and/or influencing of the tapping or dispensing process and/or of the storage process. The data from the individual transporter are read in a contact-less or contact-free manner by means of a reader unit.

The individual transporter can be, for example, an RFID tag, i.e. an electronic component which comprises essentially a structure that acts as an antenna and an electronic system in the form of an integrated circuit that also has a data memory. Stored in the memory, among other things, are also the product-specific parameters or the product-specific identification. The electronic system is thereby realized so that it itself generates the power supply necessary or desired for operation from a radio or HF signal (electromagnetic waves) received via the antenna structure from the reader unit and makes possible a wireless or contactless data transfer by means of the reader unit, in one possible embodiment also for the readout of the product-specific parameters or identification. Data or information media of this type are also known as "smart cards."

During storage, on the basis of the product-specific parameters, among other things the storage temperature, and during the tapping or dispensing process the dispensing temperature, i.e. the temperature at which the product or beverage in question is introduced into a drinking vessel, e.g. a drinking glass or mug, are controlled, which essentially guarantees or promotes an optimal drinking temperature, with beer for example a drinking temperature of approximately seven degrees Celsius.

On the basis of the product-specific parameters, for example, it is possible to control the depressurization of carbonated products from the pressure that prevails in the barrel or keg to the ambient pressure that prevails at the mouth of a tapping point, such as a dispenser tap, for example, and in one possible embodiment by at least one throttle unit with at least one throttle in a product line for the product to be dispensed which is controlled or set as a function of the product-specific parameters. In a keg filled with beer, for example, an internal pressure of three bar to three and one-half bar prevails, which corresponds to the saturation pressure at a $CO_2$ content of four and one-half gr/l. The pressure is then approximately one bar at the mouth of the tapping point, i.e. at the dispenser tap. By means of the throttle unit which is controlled on the basis of the product-specific parameters, this pressure difference is gently reduced so that there is no outgassing of $CO_2$ from the product and no undesirable foaming in the product line that connects the keg with the tapping point, although a certain amount of foaming to produce a head of foam on the beverage is generally allowable and desirable.

Some beers, in addition to $CO_2$, may comprise nitrogen gas ($N_2$). The apparatus of the present application may also be used to store and dispense beers comprising $CO_2$ and $N_2$.

The present application makes it possible to eliminate, restrict, and/or minimize potential errors in the tapping or dispensing process or during the storage process that have an adverse effect on the taste.

The tapping system according to the present application can be, for example, a stationary installation in a restaurant. The present application eliminates, restricts, and/or minimizes the disadvantages on those tapping systems that are operated under variable and changing ambient conditions and are thereby exposed in one possible embodiment to environmental factors that vary in the short term, for example in mobile dispensing systems and or in dispensing systems which are used at outdoor events, etc. Products within the meaning of the present application are in one possible embodiment beverages of the widest possible variety such as, for example, mineral or table water, soft drinks, fruit juices, wine, beer etc., as well as other liquid products.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described according to the present application. The present application is explained in greater detail below on the basis of the possible embodiments illustrated in the accompanying figures, in which.

DESCRIPTION OF EMBODIMENT OR EMBODIMENTS

Figure 1:
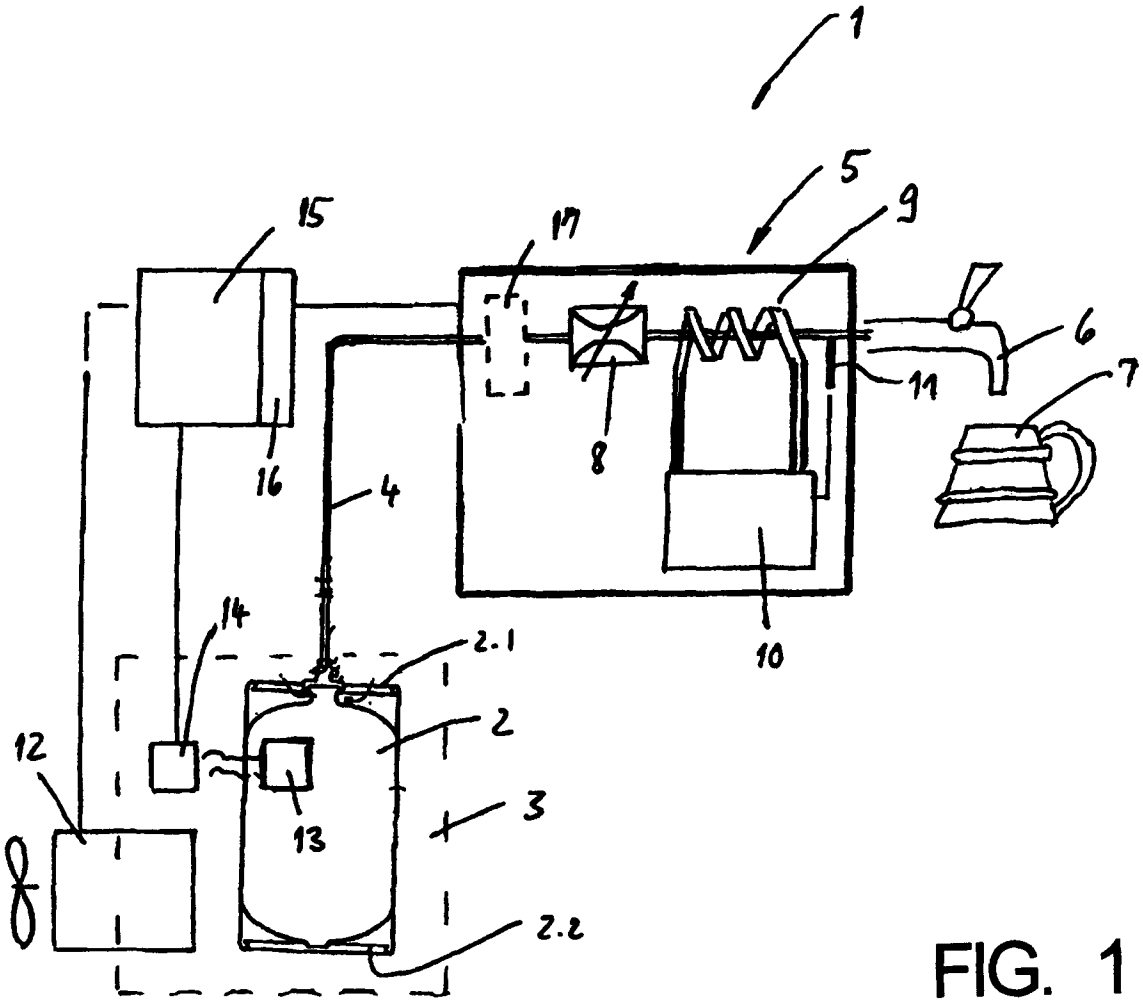
FIG. 1 shows, in a schematic function or block diagram, a dispensing system according to the present application with a single tapping device.

In FIG. 1, the number 1 designates generally a dispensing system for a carbonated product or beverage, such as beer, for example. The product is supplied in a barrel or a keg 2, which houses this product under pressure, e.g. beer at a pressure between three bar and three and one-half bar. At least the keg 2 in use is placed, for the cooling of the product, in a cooled storage room 3, which can be, for example, a cooled indoor room, cellar or the interior of a cooling device such as a refrigerator, for example.

By means of a product line 4, the keg 2 which is in use is connected with a tapping device 5 which has, among other things, the dispenser tap 6 which forms the tapping point for the controlled dispensing of the product, i.e. in the illustrated embodiment the manually controlled dispensing of the product into the individual drinking vessel 7 and has, in the liquid connection to the dispenser tap 6, at least one adjustable throttle unit 8 having a throttle and a heat exchanger 9 through which the product flows. The essential purpose of the throttle unit 8 is to achieve, by means of a corresponding throttle setting, a gentle reduction of pressure between the pressure prevailing in the keg 2 and the ambient pressure at which the product flows out of the dispenser tap 6 into the drinking vessel 7, to thereby prevent, restrict, and/or minimize an outgassing of $CO_2$ inside the tapping device 5 and/or inside the product line 4, without thereby losing the foam head in the individual drinking vessel 7 which is desirable in the pouring of beer.

The setting of the throttle unit 8 is therefore a function of product-specific parameters. It depends on, among other things, the type of product, the specific $CO_2$ content of the product, the storage temperature provided or recommended for this product, i.e. the temperature of the cooled storage room 3, the pressure in the interior of the kegs 2 used, i.e. e.g. the $CO_2$ saturation pressure of the respective carbonated product, etc.

The essential purpose of the heat exchanger is to cool the product as it flows through the open dispenser tap, if and to the extent that its temperature is above the desired or recommended drinking temperature, and/or to heat it if and to the extent that the product temperature is below the desired or recommended drinking temperature. For this purpose the heat exchanger 9 is connected with a control and supply unit 10 which provides a medium to the heat exchanger 9 that cools or heats the product, and in one possible embodiment, among other things, under the control of a sensor 11 which measures the product temperature. 12 also designates a cooling unit to cool the storage room 3.

One possible feature of the dispensing system 1 of the present application is therefore that the adjustable throttle unit 8, the heat exchanger 9 and/or its control and supply unit 10, and in the illustrated embodiment also the cooling unit 12 and thus the tapping or dispensing process and the storage process, are controlled as a function of product-specific parameters. For this purpose the data necessary or desired for the control of the tapping or dispensing process are stored in the form of product-specific parameters in the memory of a transponder 13 (RFID circuit or RFID tag) which is fastened to the respective keg 2 in a suitable manner in a location such that this transponder is protected against damage during the handling of the keg 2, for example underneath an upper protective ring 2.1 which encircles the keg frame or below a base ring 2.2.

In at least one possible embodiment according to the present application, the transponder 13 may comprise a radio frequency identification device or tag. The transponder 13 may also comprise a bar code, a magnetic strip, or other readable technology.

For the readout of the data, a reader unit 14 is provided in the storage room 3, which reader unit 14 is a component of a control unit 15 which controls, as a function of the respective beverage-specific or product-specific parameters, the throttle unit 8, the control and supply unit 10 and, by means of the cooling unit 12, the temperature of the storage room 3 and thus the product temperature inside the kegs 2.

As seen in FIG. 1, a flow meter 17 may be disposed on the product line 4. The flow meter 17 is configured to measure the quantity or volume of liquid being dispensed from the keg 2. By measuring the amount of liquid being dispensed from the keg 2, the control device 15 can determine how much liquid remains in the keg 2. The control device 15 may then determine the pressure inside the keg 2, depending on the quantity or volume of liquid in the keg 2. To promote an optimal dispensing pressure, the control device 15 may then adjust the throttle unit 8 to reduce the pressure in the keg 2 to an ambient pressure at which the product flows out of the dispenser tap 6 into the drinking vessel 7.

The data read out of the transponder 13 are stored, for example, in a data storage medium 16 of the control unit 15, and on the basis of this data, then, for example, immediately or generally after the connection of a keg 2 to the dispensing system 1, the throttle unit 8 is set, and during dispensing operation, taking into consideration the product temperature measured by the temperature sensor, the throttle unit is set on the basis of the product temperature measured by the temperature sensor 11.

As further seen in FIG. 1, the cooled storage room 3 could comprise a draft beer cooler, a draft beer dispenser, a keg refrigerator, a kegerator, a refrigerated direct draw beer dispenser, a keg beer dispenser, a keg cooler, or other keg cooling equipment. One example of a cooled storage area 3 could comprise an 84" Three Door Self-Container Four Keg Cooler, having the model number KC84-L1-BS(LLR), which is manufactured by Glastender, Inc., 5400 North Michigan Road, Saginaw, Mich. 48604-9780.

In one possible embodiment of the present application, the keg 2 stored in the cooled storage area 3 may be stored at a storing temperature in the cooled storage area 3. This storing temperature is not the desired serving temperature. For example, the storage temperature may be five degrees Celsius, but the desired serving temperature may be seven degrees Celsius. The storage cooling area 3 could store a keg 2 at five degrees Celsius, then during the tapping process, the heat exchanger 9 could then heat the product in the product line 4 up two degrees Celsius, or to the desired serving temperature, seven degrees Celsius.

In one possible embodiment of the present application, the desired storage temperature could be higher than the desired serving temperature. For example, the desired storage temperature of the product could be seven degrees Celsius, and the desired serving temperature is five degrees Celsius. The storage cooled area 3 could store a keg 2 at seven degrees Celsius, then during the tapping process, the heat exchanger 9 could then heat the product in the product line 4 down two degrees Celsius, or to the desired serving temperature, five degrees Celsius.

Figure 2:
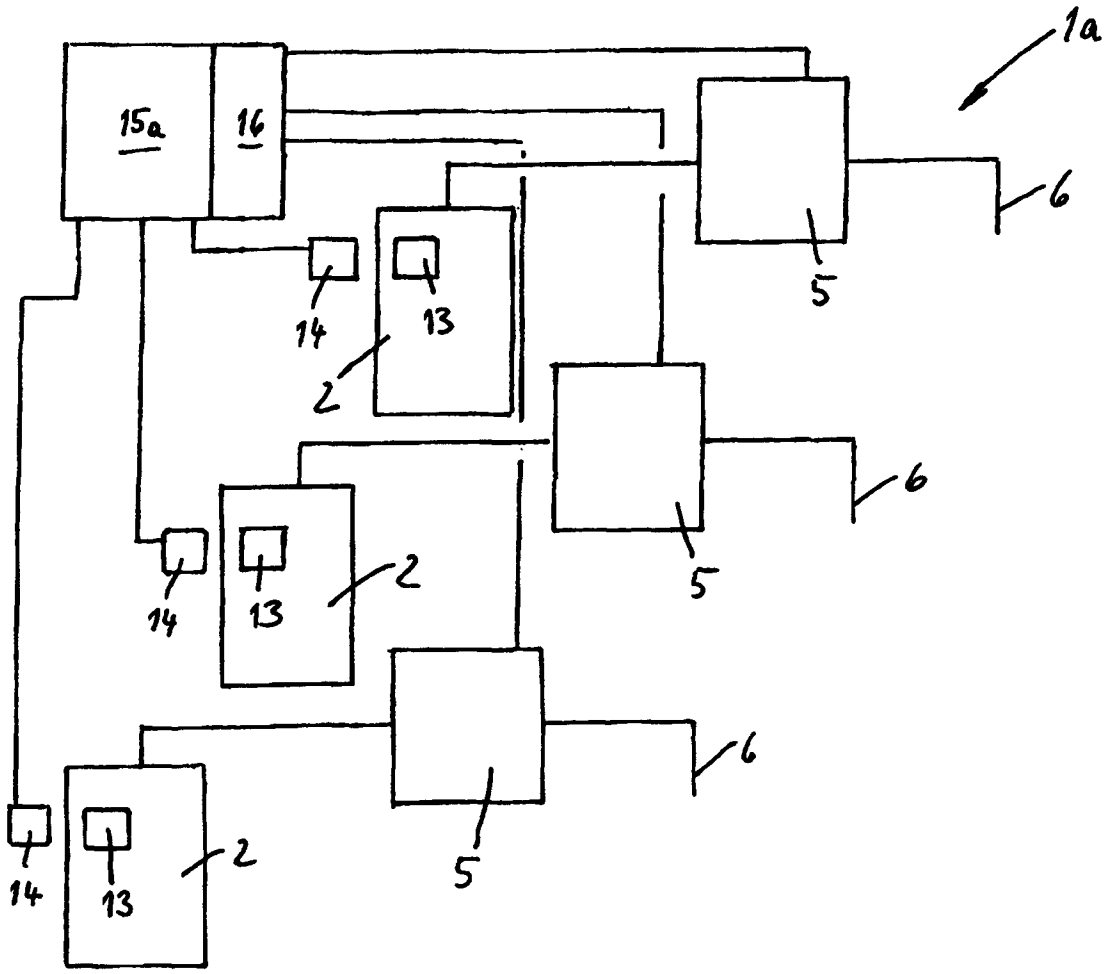
FIG. 2 shows, in a schematic illustration, a dispensing system with a plurality of tapping devices for a plurality of different products or beverages.

FIG. 2 shows a dispensing system 1*a* which, for the dispensing of different products, has a plurality of tapping devices 5, each of which corresponds to the tapping device 5 of the dispensing system 1 of FIG. 1. In FIG. 2, a keg 2 for the product in question is connected to each tap device 5 via the product line 4. The tapping devices 5 [are] controlled individually means of a common control device 15*a* as a function of the product-specific or beverage-specific parameters, and in one possible embodiment in turn by a product-specific setting of the product temperature, via the heat exchanger 9, and the associated control and supply unit 10. For this purpose, the control unit 15*a* is connected with a plurality of reader units 14, each of which interacts with a transporter 13 on the keg 2 in question.

In this possible embodiment, too, the product-specific parameters for each product that are read with the reader devices 14 are stored separately in the data memory 16 of the control device 15*a*. On the basis of these data, after the connection of a keg 2 to the associated switching device 5, the throttle unit 8 is set. During the dispensing operation, the heat exchanger 9 is constantly or substantially constantly controlled by means of the control and supply unit 10 on the basis of the data stored in the memory 16 and in consideration of the product temperature measured by the sensor 11.

The present application was described above on the basis of possible embodiments. It goes without saying that numerous modifications and variants are possible without thereby going beyond the teaching of the present application.

In the preceding description, for example, it was assumed that the throttle unit 8 of the respective dispensing device 5 is set one time at the beginning of the tapping or dispensing process to correspond to the product-specific parameters. Basically it is also possible to perform a manual resetting of the throttle setting and/or an automatic dynamic throttle adjustment, e.g. on the basis of a typical curve for the respective product which reproduces the pressure of a keg 2 as a function of the level of liquid in the keg. This curve can then also be stored, for example, in the form of a product-specific parameter in the transponder 13 of the corresponding keg 2. To take into consideration the emptying of the respective keg 2 during the dispensing process, each dispensing device 5 therefore has, among other things, a flow meter indicated as 17 in FIG. 1, which supplies a corresponding measurement signal to the control device 15, and in one possible embodiment together with the specified or initial quantity of liquid in the keg.

It was further assumed in the above description that the product-specific parameters themselves are stored in the respective transponder 13. To reduce the required or desired memory capacity in the transponder 13 and to increase the number of product-specific parameters that can be taken into consideration in the tapping or dispensing process, with a simultaneous or substantially simultaneous reduction of the scope of the data, it is also possible to store these parameters in the memory 16 of the respective control device 15 or 15*a*, for example even in the form of typical combinations for the products, whereby in that case a beverage-specific or product-specific identification is stored in the individual transponder 13, with which the beverage-specific or product-specific parameters stored in the memory 16 of the control device 15 or 15*a* and/or the product-specific programs stored in the memory 16 are retrieved or activated for the control of the tapping or dispensing process and/or of the storage process.

The present application was described above on the basis of possible embodiments. It goes without saying that numerous modifications and variants are possible without thereby going beyond the teaching of the present application.

In the context of this present application, the terms "barrel" and "keg" are used to mean types of containers designed to hold liquids which can be connected with a tap device, in one possible embodiment by means of a detachable connection. Accordingly, applications which use known bulk beverage containers for use in bulk systems, e.g. those with a volume of three meters cubed, and/or bottle-like containers made of plastic and having a volume of five liters also fall within the teaching of the present application.

In a method for the dispensing of a beverage stored in a container such as a keg, for example, using at least one dispensing device and as a function of beverage-specific parameters, the tapping or dispensing process is performed taking into consideration data which are stored in a beverage-specific manner in at least one RFID tag provided on the respective container.

One feature or aspect of an embodiment is believed at the time of the filing of this patent application to possibly reside broadly in a method for the dispensing of products, in one possible embodiment beverages, housed and supplied in barrels 2 such as kegs, for example, with the use of at least one tapping device 5 with at least one tapping point 6 and as a function of beverage-specific or product-specific parameters, wherein the dispensing or tapping or dispensing process is performed under the control or influence of data which are stored in a product-specific manner in at least one transponder 13, whereby the at least one transponder 13 is provided on the barrel 2 that houses the product to be dispensed.

Another feature or aspect of an embodiment is believed at the time of the filing of this patent application to possibly reside broadly in the method, wherein the storage process at least of the barrel 2 housing the product to be dispensed is also conducted as a function of the data that are stored in the at least one transponder 13 provided on the barrel 2.

Yet another feature or aspect of an embodiment is believed at the time of the filing of this patent application to possibly reside broadly in a method for the storage of products, in one possible embodiment beverages, housed in barrels 2, in one possible embodiment kegs, as a function of beverage-specific or product-specific parameters, wherein the storage or the storage process is performed under the control or influence of data which are stored in a product-specific manner in at least one transponder 13, which (transponder) is provided on the barrel 2 that houses the product.

Still another feature or aspect of an embodiment is believed at the time of the filing of this patent application to possibly reside broadly in the method, wherein the respective transponder 13 is an RFID tag.

A further feature or aspect of an embodiment is believed at the time of the filing of this patent application to possibly reside broadly in the method, wherein the data stored in the respective transponder 13 are the beverage-specific or product-specific parameters.

Another feature or aspect of an embodiment is believed at the time of the filing of this patent application to possibly reside broadly in the method, wherein the data stored in the respective transponder 13 are at least one beverage-specific identification, by means of which the beverage-specific or product-specific parameters stored in a control unit 15, 15*a* and/or a beverage-specific or product-specific program for the control or influencing of the tapping or dispensing process and/or of the storage process are activated and/or retrieved.

Yet another feature or aspect of an embodiment is believed at the time of the filing of this patent application to possibly reside broadly in an apparatus for the dispensing of products, in one possible embodiment beverages, housed in barrels 2, for example kegs, as a function of beverage-specific or product-specific parameters, with at least one tapping device 5 with at least one tapping point 6, comprising a control device 15, 15*a* which for the control of the dispensing or of the tapping process or dispensing process is realized in consideration of data that are stored in a product-specific manner in at least one transponder 13 provided on the respective barrel 2.

Still another feature or aspect of an embodiment is believed at the time of the filing of this patent application to possibly reside broadly in the apparatus, wherein the control device 15, 15*a* is realized for the control of the storage process of the respective product, for example for the cooling of the product, as a function of the data that are stored in the at least one transponder 13 which is provided on the respective barrel 2.

A further feature or aspect of an embodiment is believed at the time of the filing of this patent application to possibly reside broadly in an apparatus for the storage of products, in one possible embodiment beverages housed in barrels 2, for example kegs, as a function of beverage-specific or product-specific parameters, comprising a control device 15, 15*a* which is realized for the control of the storage process, taking into consideration data that are stored in a product-specific manner in at least one transponder 13 which is provided on the respective barrel 2.

Another feature or aspect of an embodiment is believed at the time of the filing of this patent application to possibly reside broadly in the device, comprising a cooling or storage room 3 for at least one barrel 2 with a cooling 12 controlled by the control device 15, 15*a*.

Yet another feature or aspect of an embodiment is believed at the time of the filing of this patent application to possibly reside broadly in the device, wherein the respective transponder 13 is an RFID tag.

Still another feature or aspect of an embodiment is believed at the time of the filing of this patent application to possibly reside broadly in the apparatus, wherein the data stored in the respective transponder 13 are the beverage-specific or product-specific parameters.

A further feature or aspect of an embodiment is believed at the time of the filing of this patent application to possibly reside broadly in the apparatus, wherein the data stored in the respective transponder 13 are at least one beverage-specific identification, by means of which the beverage-specific or product-specific parameters stored in the control unit 15, 15*a* and/or a beverage-specific or product-specific program are activated and/or retrieved for the control of the tapping or dispensing process and/or of the storage process.

One feature or aspect of an embodiment is believed at the time of the filing of this patent application to possibly reside broadly in the apparatus, comprising at least one throttle unit 8 which is provided in the at least one tapping device 5 flowed through by the product, which is controlled by the control unit 15, 15*a* as a function of the product-specific parameters, and in one possible embodiment for the reduction of the pressure in the barrel 2 to a tapping pressure.

Another feature or aspect of an embodiment is believed at the time of the filing of this patent application to possibly reside broadly in the apparatus, wherein in the at least one tapping device 5 through which the product flows, means 9, 10 controlled by the control unit 15, 15*a* as a function of the product-specific parameters are provided to regulate or control the product temperature at the tapping point 6.

Yet another feature or aspect of an embodiment is believed at the time of the filing of this patent application to possibly reside broadly in the apparatus, comprising a plurality of tapping devices 5, each of which forms a tapping point 6, and which are controlled by a control unit 15, 15*a* as a function of the product-specific parameters associated with the respective product.

Still another feature or aspect of an embodiment is believed at the time of the filing of this patent application to possibly reside broadly in the apparatus, wherein their realization is in the form of a stationary dispensing system 1, 1*a*.

A further feature or aspect of an embodiment is believed at the time of the filing of this patent application to possibly reside broadly in the apparatus, wherein their realization is in the form of a mobile dispensing system.

Another feature or aspect of an embodiment is believed at the time of the filing of this patent application to possibly reside broadly in a method for the dispensing of products in the form of beverages supplied in barrels 2, such as kegs, for example, using at least one tapping device 5 with at least one tapping point 6 and controlled or influenced as a function of beverage-specific or product-specific parameters by data that are stored in a product-specific manner in at least one transponder 13 which is provided on a barrel 2, wherein the product-specific dispensing or the product-specific tapping or dispensing process of the beverage supplied ready-to-drink in the respective barrel 2 is controlled or influenced by the data in the transponder 13.

Yet another feature or aspect of an embodiment is believed at the time of the filing of this patent application to possibly reside broadly in an apparatus for the dispensing of products in the form of beverages supplied in barrels 2, such as kegs, for example, at least one tapping device 5 with at least one tapping point 6 and with a control device 15, 15*a* which is realized for the control of the dispensing or of the tapping or dispensing process taking into consideration data that are stored in a product-specific manner in at least one transponder 13 which is provided on the respective barrel 2, wherein the control device 15, 15*a* is realized for the control of a product-specific dispensing or the product-specific tapping or dispensing process of the beverage supplied ready-to-drink in the respective barrel 2 controlled or influenced by the data in the transponder 13.

Yet another feature or aspect of an embodiment is believed at the time of the filing of this patent application to possibly reside broadly in a method for the dispensing of products, in one possible embodiment beverages, supplied in barrels 2, such as kegs, for example, using at least one tapping device 5 with at least one tapping point 6 and controlled or influenced as a function of beverage-specific or product-specific parameters by data that are stored in a product-specific manner in at least one transponder 13 which is provided on a barrel 2, wherein a regulation or control system of the beverage temperature at the tapping point 6 controlled by or influenced by the data, and/or a throttle unit 8 through which the product flows is controlled to reduce the pressure in the barrel 2 to a tapping pressure.

Still another feature or aspect of an embodiment is believed at the time of the filing of this patent application to possibly reside broadly in a method for the dispensing of products, in one possible embodiment beverages, supplied in barrels 2, such as kegs, for example, using at least one tapping device 5 with at least one tapping point 6 and controlled or influenced as a function of beverage-specific or product-specific parameters by data that are stored in a product-specific manner in at least one transponder 13 which is provided on a barrel 2, wherein the data stored in the respective transponder are at least a beverage-specific identification, by means of which the beverage-specific or product-specific parameters stored in the respective transponder 13 and/or a beverage-specific or product-specific program for the control or influencing of the tapping or dispensing process and/or of the storage process are activated and/or retrieved.

A further feature or aspect of an embodiment is believed at the time of the filing of this patent application to possibly reside broadly in a method for the storage of products, in one possible embodiment beverages, stored in barrels 2, in one possible embodiment kegs, as a function of beverage-specific or product-specific parameters, wherein the storage or the storage process is controlled or influenced by data that are stored in a product-specific manner in at least one transponder 13, which (transponder) is provided on the barrel 2 that houses the product.

Another feature or aspect of an embodiment is believed at the time of the filing of this patent application to possibly reside broadly in the method, wherein a regulation or control system of the beverage temperature at the tapping point 6 controlled by or influenced by the data, and/or a throttle unit 8 through which the product flows is controlled to reduce the pressure in the barrel 2 to a tapping pressure.

Yet another feature or aspect of an embodiment is believed at the time of the filing of this patent application to possibly reside broadly in an apparatus for the dispensing of products, in one possible embodiment beverages, supplied in barrels 2, such as kegs, for example, with at least one tapping device 5 with at least one tapping point 6 and with a control device 15, 15*a*, which is realized for the control of the dispensing or of the tapping or dispensing process taking into consideration product-specific data that are stored in a product-specific manner in at least one transponder 13 which is provided on the respective barrel 2, wherein the regulation or control system 15, 15*a*, controlled by or influenced by the data, performs a regulation or control of the product temperature at the tapping point 6 and or a throttle unit 8 through which the product flows is controlled to reduce the pressure in the barrel 2 to a tapping pressure.

Still another feature or aspect of an embodiment is believed at the time of the filing of this patent application to possibly reside broadly in an apparatus for the dispensing of products, in one possible embodiment beverages, supplied in barrels 2, such as kegs, for example, with at least one tapping device 5 with at least one tapping point 6 and with a control device 15, 15*a* which is realized for the control of the dispensing or of the tapping or dispensing process taking into consideration data that are stored in at least one transponder 13 which is provided on the respective barrel 2 in the form of at least a beverage-specific identification, wherein the control device 15, 15*a* is realized so that by means of the at least one beverage-specific identification, beverage-specific or product-specific parameters stored in the control unit 15, 15*a* and/or a beverage-specific or product-specific program for the control of the tapping or dispensing process and/or of the storage process are activated and/or retrieved.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of RFID tags which may possibly be utilized or adapted for use in at least one possible embodiment of the present application may possibly be found in the following U.S. Pat. No. 7,492,252, having the title "RFID TAG AND METHOD FOR OBTAINING INFORMATION ON ARTICLE USING THE SAME," published on Feb. 17, 2009; U.S. Pat. No. 7,498,940, having the title "RFID SYSTEM UTILIZING PARAMETRIC RERADIATED TECHNOLOGY," published Mar. 3, 2009; U.S. Pat. No. 7,501,947, having the title "RFID TAG WITH SMALL APERTURE ANTENNA," published Mar. 10, 2009; U.S. Pat. No. 7,503,491, having the title "RFID CHIP AND ANTENNA WITH IMPROVED RANGE," published Mar. 17, 2009; and No. 7,504,952, having the title "WIDE BAND RFID SYSTEM WITH TAG ON FLEXIBLE LABEL," published on Mar. 17, 2009.

Some examples of systems for reading RFID tags or RFID readers which may possibly be utilized or adapted for use in at least one possible embodiment of the present application may possibly be found in the following U.S. Pat. No. 7,492,258, having the title "SYSTEMS AND METHODS FOR RFID SECURITY," published Feb. 17, 2009; U.S. Pat. No. 7,495,560, having the title "WIRELESS PICOCELLULAR RFID SYSTEMS AND METHODS," published on Feb. 24, 2009; U.S. Pat. No. 7,504,945, having the title "METHOD AND SYSTEM FOR TRACKING AND MONITORING STATUS OF DATA STORAGE SUBSYSTEM COMPONENTS," published Mar. 17, 2009; and No. 7,504,949, having the title "METHOD AND APPARATUS FOR INDIRECT ASSET TRACKING WITH RFID," published Mar. 17, 2009.

The following patents, patent applications or patent publications, are hereby incorporated by reference as if set forth in their entirety herein: DE 199 48 471 C2, having the following English translation of the German title "DISPENSER WITH A CODE READER AND A DATA PROCESSING UNIT AND THE UTILIZATION THEREOF," published on Apr. 19, 2001.

All of the patents, patent applications or patent publications, which were cited in the International Search Report dated May 26, 2008, and/or cited elsewhere are hereby incorporated by reference as if set forth in their entirety herein as follows: WO 03/005295, having the title "METHOD AND SYSTEM OF SETTING AND/OR CONTROLLING OF A FOOD PRODUCT DISPENSING MACHINE USING A TAG-TYPE COMMUNICATION DEVICE," published on Jan. 16, 2003; DE 44 46 203, having the following German title "VERFAHREN ZUR DIGITALEN ERFASSUNG DES UMLAUFS VON BIERFASSERN," published on Jun. 27, 1996; and DE 298 22 967, having the following English translation of the German title "DEVICE FOR DISCHARGING FLOWABLE MATERIALS AND METHOD OF USING SAME," published on Jun. 15, 2000.

All of the patents, patent applications or patent publications, which were cited in the German Office Action dated Jan. 31, 2007, and/or cited elsewhere are hereby incorporated by reference as if set forth in their entirety herein as follows: US 2005/0103799, having the title "FLUID DISPENSING SYSTEM SUITABLE FOR DISPENSING LIQUID FLAVORINGS," published on May 19, 2005; US 2004/0084475, having the title "BEVERAGE FORMING AND DISPENSING SYSTEM," published on May 6, 2004; DE 601 15 184, having the following English translation of the German title "INK JET PRINTING SYSTEM, INK CONTAINER AND METHOD OF PREPARING THE SAME," published on Jul. 13, 2006; WO 2004/056695, having the title "BEVERAGE DISPENSER WITH AUTHENTICATING KEY," published on Jul. 8, 2004; WO 2005/070816, having the title "BEVERAGE DISPENSER," published on Aug. 4, 2005; and DE 28 27 900, having the following German title "VERFAHREN UND VORRICHTUNG ZUR STEUERUNG DES ZUSTANDS VON GETRAENKEN IM AUSSCHANK," published Jan. 17, 1980.

The patents, patent applications, and patent publication listed above in the preceding five paragraphs, beginning with the phrase: "Some examples of RFID tags . . . " and ending with the phrase: " . . . published Jan. 17, 1980," are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 047 524.0, filed on Oct. 7, 2006, having inventor Volker TILL, and DE-OS 10 2006 047 524.0 and DE-PS 10 2006 047 524.0, and International Application No. PCT/EP2007/007816, filed on Sep. 7, 2007, having WIPO Publication No. WO 2008/040434 and inventor Volker TILL, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/007816 and German Patent Application 10 2006 047 524.0 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/007816 and DE 10 2006 047 524.0 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1, 1*a* Dispensing system
2 Keg
3 Storage room
4 Product line
5 Tapping device
6 Dispenser tap
7 Drinking vessel
8 Adjustable throttle unit
9 Heat exchanger
10 Control or supply unit for the heat exchanger
11 Temperature sensor
12 Cooling unit
13 RFID tag
14 Reader unit or reader head
15, 15*a* Control unit
16 Memory of control unit 15 or 15*a*
17 Flow meter

What is claimed is:

1. A method of handling beverage kegs, said method comprising the steps of:

storing a beverage keg in a storage arrangement;

connecting said beverage keg, via a product line arrangement, to at least one dispenser tap configured to be opened to permit dispensing of beverage into a container, and configured to be closed to stop dispensing of beverage into a container;

reading beverage-specific data from a transponder disposed on or in said beverage keg;

controlling, according to said beverage-specific data, dispensing of beverage and/or storage conditions of said beverage keg;

variably adjusting, according to said beverage-specific data, a throttle unit in said product line arrangement, through which throttle unit the beverage from said beverage keg flows, to reduce pressure from a pressure in said beverage keg to a tapping pressure at which the beverage is dispensed out of said at least one dispenser tap, before the beverage flows into said at least one dispenser tap;

heating or cooling the beverage exiting said throttle unit in said product line arrangement, according to said beverage-specific data, using a heat exchanger adjacent said at least one dispenser tap; and sensing the temperature of the beverage exiting said heat exchanger prior to dispensing the beverage.

2. The method according to claim 1, wherein said step of sensing the temperature of the beverage comprises sensing the temperature of the beverage in said product line arrangement exiting said heat exchanger immediately prior to dispensing using a temperature sensor adjacent said at least one dispenser tap.

3. The method according to claim 2, wherein said method further comprises adjusting at least one of: said heat exchanger and said storage arrangement, according to the sensed temperature of the beverage exiting said heat exchanger and said beverage-specific data, to achieve a desired temperature of dispensed beverage.

4. The method according to claim 3, wherein:

said method further comprises activating and/or retrieving a beverage-specific control program stored in a control unit according to said beverage-specific data; and said step of reading beverage-specific data from a transponder comprises reading beverage-specific data from an RFID unit.

5. The method according to claim 4, wherein:

said step of controlling storage conditions comprises adjusting the temperature of said storage arrangement according to said beverage-specific data;

said method further comprises measuring flow of beverage with a flow meter and thereby monitoring the amount of beverage in said beverage keg; and the beverage in said keg is beer, and said method further comprises controlling, with said control unit, the operation of said heat exchanger, said storage arrangement, and said throttle, according to said beverage-specific data, which data comprises the type of the beverage, the carbon dioxide content of the beverage, the desired beverage storage temperature, the carbon dioxide saturation pressure of the beverage, the desired beverage dispensing pressure, and the desired beverage drinking temperature.

6. The method according to claim 1, wherein said method further comprises gently reducing the pressure difference between the pressure in said beverage keg and the pressure at said at least one dispenser tap using said throttle, and thereby minimizing outgassing of $CO_2$ from the beverage and producing a desired head of foam on the dispensed beverage.

7. The method according to claim 6, wherein the beverage comprises beer.

8. The method according to claim 1, wherein said method further comprises controlling dispensing of beverage and/or storage conditions of said beverage keg in view of outdoor environmental conditions.

9. A beverage keg handling arrangement comprising:

a beverage keg storage arrangement configured to store a beverage keg therein;

at least one dispenser tap configured to be opened to permit dispensing of beverage into a container, and configured to be closed to stop dispensing of beverage into a container;

a product line arrangement connected to said at least one dispenser tap, and configured to be connected to a beverage keg to permit flow of beverage from a beverage keg to said at least one dispenser tap;

a receiver arrangement configured to read beverage-specific data from a transponder disposed on or in a beverage keg;

a control arrangement configured to control, according to said beverage-specific data, dispensing of beverage and/or storage conditions of a beverage keg;

a throttle unit disposed in said product line arrangement and configured to permit flow of the beverage from a beverage keg therethrough;

said throttle unit is configured to be variably adjusted, according to said beverage-specific data, to reduce pressure from a pressure in a beverage keg to a tapping pressure at which the beverage is dispensed out of said at least one dispenser tap, before the beverage flows into said at least one dispenser tap;

a heat exchanger disposed adjacent said at least one dispenser tap between said throttle unit and said dispenser tap, and configured to heat or cool the beverage from a beverage keg in said product line arrangement, according to said beverage-specific data; and a temperature sensor configured to sense the temperature of a beverage exiting said heat exchanger prior to dispensing the beverage.

10. The arrangement according to claim 9, wherein said temperature sensor is disposed immediately adjacent said at least one dispenser tap and is configured to sense the temperature of a beverage in said product line arrangement exiting said heat exchanger immediately prior to dispensing.

11. The arrangement according to claim 10, wherein said control arrangement is configured to adjust at least one of: said heat exchanger and said storage arrangement, according to a sensed temperature of the beverage exiting said heat exchanger and said beverage-specific data, to achieve a desired temperature of a dispensed beverage.

12. The arrangement according to claim 11, wherein:

said control arrangement is configured to control storage conditions by adjusting the temperature of said storage arrangement according to said beverage-specific data;

said control arrangement comprises a memory configured to store a beverage-specific control program; and said storage arrangement comprises a cooling room configured to store a beverage keg therein.

13. The arrangement according to claim 12, wherein:

said receiver arrangement is configured to read beverage-specific data from an RFID unit on or in a beverage keg; and said arrangement comprises a flow meter configured to measure flow of beverage and thereby monitor the amount of beverage in a beverage keg, which beverage comprises beer.

14. The arrangement according to claim 13, wherein:

said arrangement comprises a plurality of tapping devices, each of which defines a tapping point; and said arrangement is a stationary arrangement configured to be disposed in a commercial or residential building.

15. The arrangement according to claim 13, wherein:

said arrangement comprises a plurality of tapping devices, each of which defines a tapping point;

said arrangement is a mobile arrangement configured to be moved from one temporary location to another; and said control arrangement is configured to control dispensing of beverage and/or storage conditions of a beverage keg in view of outdoor environmental conditions.

16. The arrangement according to claim 9, wherein said throttle is configured to gently reduce the pressure difference between the pressure in a beverage keg and the pressure at said at least one dispenser tap, to thereby minimize outgassing of $CO_2$ from the beverage and produce a desired head of foam on the dispensed beverage, which beverage comprises beer.

* * * * *